US005651677A

United States Patent [19]

Hildebrandt

[11] Patent Number: 5,651,677

[45] Date of Patent: Jul. 29, 1997

[54] WARDROBE MANAGEMENT SYSTEM AND METHOD FOR USE

[76] Inventor: Michael C. Hildebrandt, 7706 Sylvan Dr., Bayonet Point, Fla. 34667

[21] Appl. No.: 710,097

[22] Filed: Sep. 11, 1996

[51] Int. Cl.[6] ..... G09B 19/00

[52] U.S. Cl. ..... 434/99; 2/145; 2/244

[58] Field of Search ..... 434/99, 395, 400, 434/238, 433; 40/122, 322; 2/145, 244, 115, 916

[56] References Cited

U.S. PATENT DOCUMENTS

| | | | |
|---|---|---|---|
| 3,040,448 | 6/1962 | Paxton | 434/99 |
| 3,124,284 | 3/1964 | Collum | 40/322 X |
| 3,775,775 | 12/1973 | Mazzenga | 434/99 X |
| 3,978,594 | 9/1976 | Pulitzer et al. | 434/99 |
| 4,514,178 | 4/1985 | Noto et al. | 434/395 |
| 4,854,880 | 8/1989 | Nasby | 40/322 |

*Primary Examiner*—Jeffrey A. Smith

*Attorney, Agent, or Firm*—American Innovations, Inc.; Dorothy S. Morse, Esq.

[57] ABSTRACT

A wardrobe management system having a log book in a calendar format with specified areas therein for recording garment identification and alpha-numeric information, a plurality of garment marking tags having garment type and numerical information recorded thereon, a plurality of fastening devices for use in removably securing marking tags to garments without permanent damage to the garments, and at least one storage container for housing the marking tags, the fastening devices, and small garment accessories, such as suit pocket handkerchiefs, jewelry, and scarves. Applications may include, but are not limited to, use in organizing men's and women's business wardrobes to ensure no repetition of clothing worn at functions attended by the same groups of people.

6 Claims, 4 Drawing Sheets

Figure 4
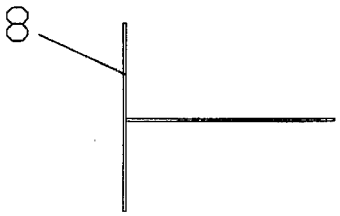
Figure 5
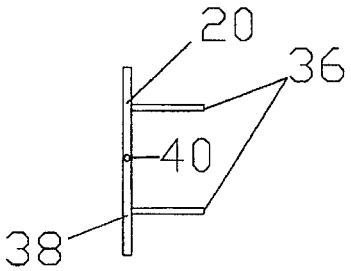
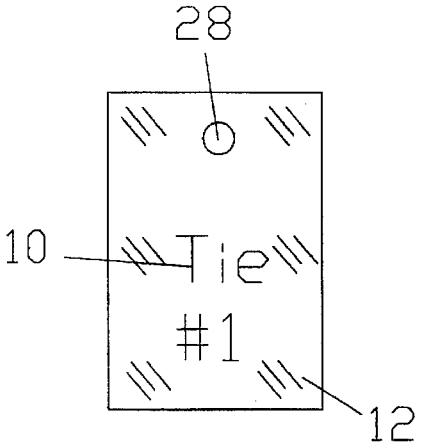
Figure 6
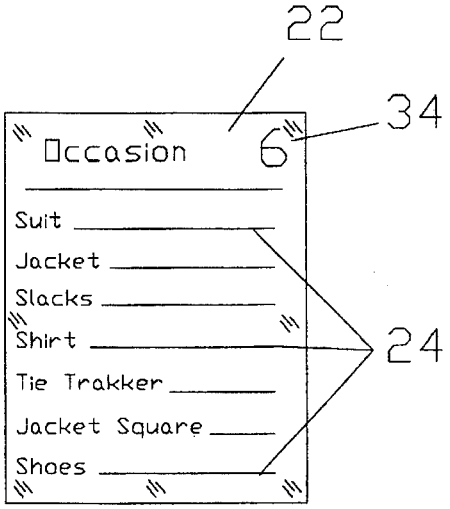
Figure 7

WARDROBE MANAGEMENT SYSTEM AND METHOD FOR USE

BACKGROUND

1. Field of Invention

This invention relates to organizational and planning systems, specifically to a wardrobe management system having a log book in a calendar format with specified areas therein for recording garment identification and alpha-numeric information, a plurality of garment marking tags having garment type and numerical information recorded thereon, a plurality of fastening devices for use in removably securing marking tags to garments without permanent damage to the garments, and at least one storage container for housing the marking tags, the fastening devices, and small garment accessories, such as suit pocket handkerchiefs, jewelry, and scarves. Applications may include, but are not limited to, use in organizing men's and women's business wardrobes to ensure no repetition of clothing worn at functions attended by the same groups of people.

2. Description of Prior Art

It is important to some people to avoid wearing the same clothing to sequential related gatherings attended by the same people. Being seen in different clothing when in the presence of those who know you, tends to support an appearance of success. Many individuals are concerned about their appearance and would benefit from a wardrobe organizing system which permitted them to keep track of the garments and garment accessories they have worn on different occasions so that they can appropriately plan the wearing of such garments in the future.

It is known in the field of organizational systems to have systems which organize pharmaceutical labeling, the appearance of gardens, and the scheduling of medications. The invention in U.S. Pat. No. 4,277,089 to Lockhart (1981) discloses a pharmaceutical record and labeling system. The Lockhart system comprises a backing sheet to which are attached two series of adhesively backed label segments, one series for pharmaceutical information and one series for additional information. As the labels are filled out, the backing sheet retains information transferred from the label segments for a permanent record of information. U.S. Pat. No. 5,246,253 to Mykrantz (1993) discloses a garden planning kit having a book, two binders, and a plurality of transparent overlays for envisioning the appearance of a garden at different times during the year when the plants are in varying stages of growth.

The inventions in U.S. Pat. No. 5,393,100 to Coe (1995) and U.S. Pat. No. 5,431,450 to Coleman (1995) disclose systems for scheduling the taking of medications. The Coe system comprises a support, a pad of medicine schedules, and a plurality of medicine display cards. Each medicine display card carries multiple stickers each having a picture of a tablet shape, or other representation for that medication, for transfer to one of the medicine schedules. Each medicine schedule has a place for attachment of medicine stickers and space for instructions for taking the medication. Thus the Coe invention provides a graphic indication of which medications must be taken and instructions therefore. Similarly, the Coleman invention comprises a chart or board with a calendar section having spaces in which to check off medications as they are used, a marking device such as a dry erase marker used to check off the medication usage, a medicine recessed tray in which to centrally organize all medications to be taken by a patient, and markers to attach to the chart or board for additional reminders such as the need for a doctor's visit prior to refilling a prescription. None of these organizational systems would efficiently be applied to the recording of garments worn on specific occasions, the recording of descriptions of each garment worn and its assigned marking tag alpha-numeric information, and the simple planning of future wearing of each garment. It is not known in this field to have a wardrobe management system having a log book in a calendar format with specified areas therein for recording garment identification and alpha-numeric information, a plurality of garment marking tags having garment type and numerical information recorded thereon, a plurality of fastening devices for use in removably securing marking tags to garments without permanent damage to the garments or marking tags, and at least one storage container for housing the marking tags, the fastening devices, and small garment accessories, such as suit pocket handkerchiefs, jewelry, and scarves.

SUMMARY OF INVENTION

Objects and Advantages

It is the primary object of this invention to provide a wardrobe management system so that a person can keep track of the garments worn to different functions. It is also an object of this invention to provide a wardrobe management system so that a person can plan the garments to be worn to future meetings and functions. A further object of this invention is to provide a wardrobe management system which will keep track of both garments and garment accessories. It is also an object of this invention to provide a wardrobe management system which includes a storage container for small garment accessories, marking tags, and fasteners for attaching the marking tags to garments.

As described herein, properly manufactured and used, the present invention would provide a wardrobe management system which would help a person concerned with their appearance in not repeating clothing worn to meetings and functions that are sequential or otherwise related by attendance of the same people. A log book would store information about each garment or garment accessory and its prior usage. As a marking tag having unique alpha-numeric information is attached to each garment and garment accessory, the alpha-numeric information is recorded in the log book with a description of the garment or garment accessory to which it is attached. Thereafter, the garment or garment accessory is identified only by its simplified alpha-numeric identification, instead of its entire fiber content, texture, and color description. Thereafter, in planning clothing to be worn to future gatherings, the history of use information can be reviewed to avoid repetition of wearing the same garments to sequential and related functions. It is contemplated for small removable fasteners to be used to affix each unique marking tag to a garment without causing permanent damage to the garment. In addition, the present invention would include a storage container having pockets for housing the marking tags, the removable fasteners, and garment accessories small enough to fit into the pockets, such as jewelry, suit pocket handkerchiefs, and scarves.

The description herein provides preferred embodiments of the present invention but should not be construed as limiting the scope of the wardrobe management system invention. Variations in the size and configuration of the storage container, the size, number, and configuration of the pockets used, the material from which the storage container and marking tags are made, the size of the marking tags, and the configuration of fasteners used to affix the marking tags to garments, other than those shown and described herein, may be incorporated into the present invention. Thus the scope of the present invention should be determined by the appended claims and their legal equivalents, rather than the examples given.

BRIEF DESCRIPTION OF THE DRAWINGS

FIG. 4 is a side view of a preferred embodiment of the male portion of a fastening device of the invention for attaching the marking tags to garments and garment accessories.

FIG. 5 is a side view of a preferred embodiment of the female portion of a fastening device of the invention for use with the male portion shown in FIG. 5 in attaching the marking tags to garments and garment accessories.

FIG. 6 is a front view of one preferred embodiment of a marking tag of the invention.

FIG. 7 is a front view of one preferred embodiment of a daily information log of the invention.

DETAILED DESCRIPTION OF PREFERRED EMBODIMENTS

Figure 1:
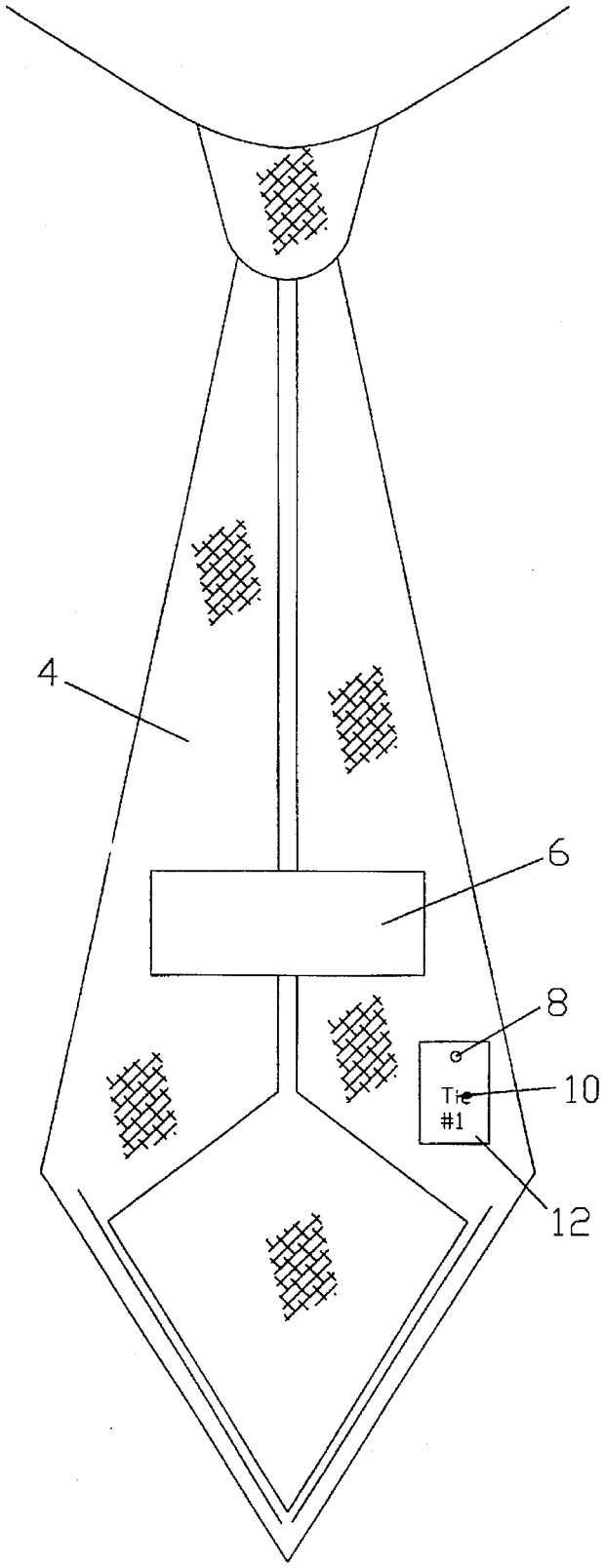
FIG. 1 is a back view of a tie having one of the marking tags of the invention attached thereto.

FIG. 1 shows the back of a tie 4 having a manufacturer's label 6 and a preferred embodiment of a marking tag 12 of the present invention attached thereto. FIG. 1 also shows marking tag 12 having alpha-numeric information 10 on its front surface and a removable male fastening device component 8 used to attach marking tag 12 to tie 4. Although the use of specific alpha-numeric information 10 as shown in FIG. 1 is not critical to the present invention, in the preferred embodiment alpha-numeric information 10 on each marking tag 12 is unique and includes identification of the garment type and a numerical designation. For example, such alpha-numeric information 10 on marking tags 12 could be simplified and recorded simply as Tie #1, Tie #2, Tie #3, Shirt #1, Shirt #2, Slacks #1, Slacks #2, Suit #1, Suit #2, Skirt #1, Skirt #2, Scarf#1, Scarf#2, etc. In one preferred embodiment of the present invention it is contemplated to have approximately eighty uniquely numbered tie marking tags 12, approximately forty uniquely numbered shirt marking tags 12, approximately twenty uniquely numbered suit marking tags 12, approximately twenty uniquely numbered jacket marking tags 12, and approximately twenty uniquely numbered slacks marking tags 12. In the preferred embodiment it is also contemplated for marking tags 12 to be small and inconspicuous and for removable male fastening device components 8 to be configured so as not to permanently damage the material of tie 4 after removal, nor be so long as to penetrate through and be exposed on the front surface of tie 4, or other garment (not shown) to which it might be attached.

Figure 2:
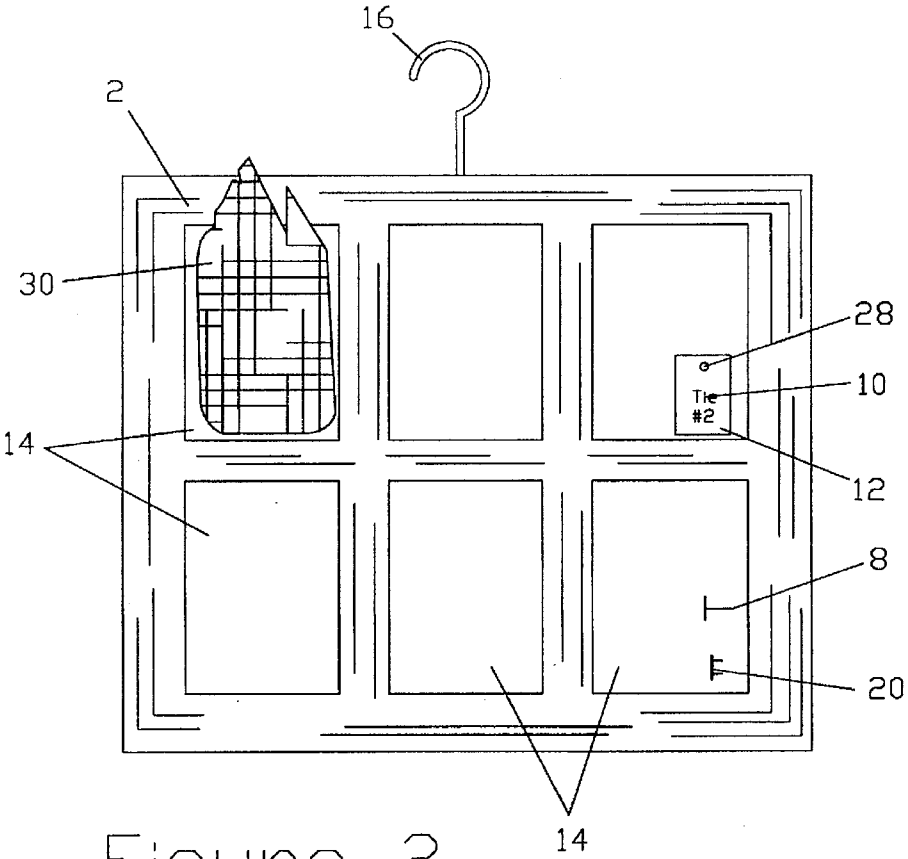
FIG. 2 is a front view of the storage container of the invention having pockets housing garment accessories, marking tags, and fastening devices.

FIG. 2 shows a storage container 2 of the present invention having a rectangular shape with six rectangularly shaped outside pockets 14 on one of its flat rectangular sides for housing garment accessories 30, marking tags 12, removable male fastening device components 8, and removable female fastening device components 20. FIG. 2 also shows a hooking member 16 attached to the upper surface of storage container 2. It is contemplated for hooking member 16 to be configured for securing storage container 2 from a standard size of garment support bar such as is commonly found in residential closets. Although storage container 2 is shown to be rectangular and having six rectangular outside pockets 14 are shown, the number of outside pockets 14, the shape of outside pockets 14, and the shape of storage container 2 are not critical to the present invention. Also, although not shown, in the preferred embodiment of the present invention it is contemplated for storage container 2 to have two flat sides with outside pockets 14 on both of those flat sides. In the preferred embodiment it is also contemplated for outside pockets 14 to be transparent for easy viewing of contents stored therein.

Figure 3:
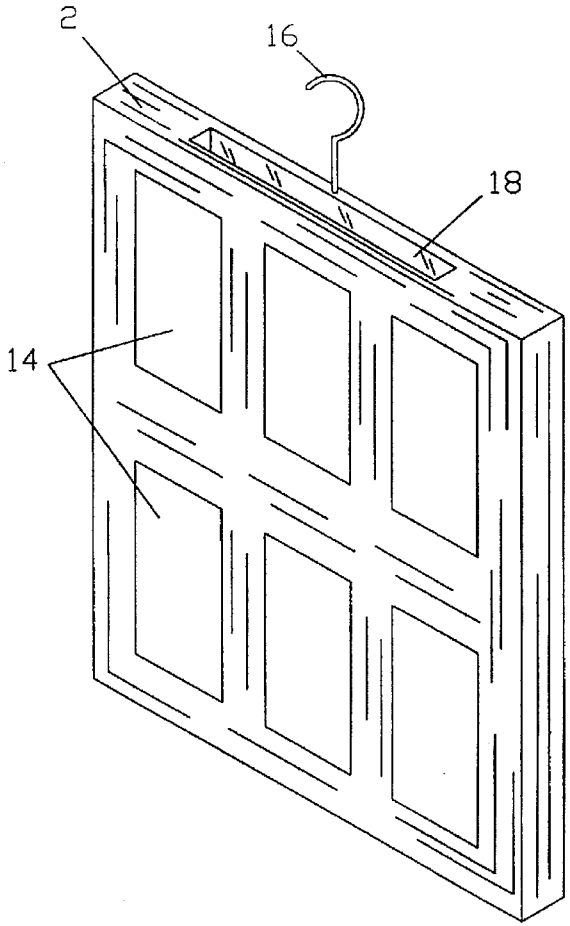
FIG. 3 is a perspective view of the storage container of the invention.

FIG. 3 also shows storage container 2 having outside pockets 14 and hooking member 16 attached to the upper surface of storage container 2. In addition, FIG. 3 shows an inside pocket 18 for housing marking tags 12, removable male fastening components 8, removable female fastening 20, and garment accessories such as jewelry (not shown) and hair ornaments (not shown). It is contemplated for storage container 2 to comprise more than one inside pocket 18.

FIG. 4 shows a preferred embodiment of removable male fastening component 8 having a T-shape, while FIG. 5 shows a preferred embodiment of removable female fastening component 20 having a base member 38 with an aperture 40 centrally located therethrough and two legs 36 for use in positioning removable female fastening component 20 against removable male fastening component 8 and secure attachment thereto. Although the specific configuration of removable female fastening components 20 and removable male fastening components 8 are not critical to the present invention, in the preferred embodiment of the present invention it is contemplated for removable female fastening components 20 and removable male fastening components 8 to be small and inconspicuous when affixing marking tags 12 to a garment such as tie 4 and to be sufficiently short in length so as not to penetrate through a garment such as tie 4 during use. It is not critical whether removable female fastening component 20 or removable male fastening component 8 is used against the front surface of marking tag 12.

FIG. 6 shows marking tag 12 having a rectangular configuration, alpha-numeric information 10 thereon, and a hole 28 therethrough for insertion of removable male fastening component 8. The rectangular configuration of marking tag 12 is not critical to the present invention. In the preferred embodiment it is contemplated for each marking tag 12 to have unique information printed thereon as to garment type and number.

FIG. 7 shows a daily information log 22 having a recording format 24 which includes spaces for recording alpha-numeric information 10, and a changeable calendar date 34. Although FIG. 7 shows recording format 24 comprising words such as Occasion, Suit, Jacket, Slacks, Shirt, Tie Trakker, Jacket Square, and Shoes, and solids lines following each word, it is not contemplated for recording format 24 to be limited to such words and the shown arrangement of such solid lines.

Figure 8:
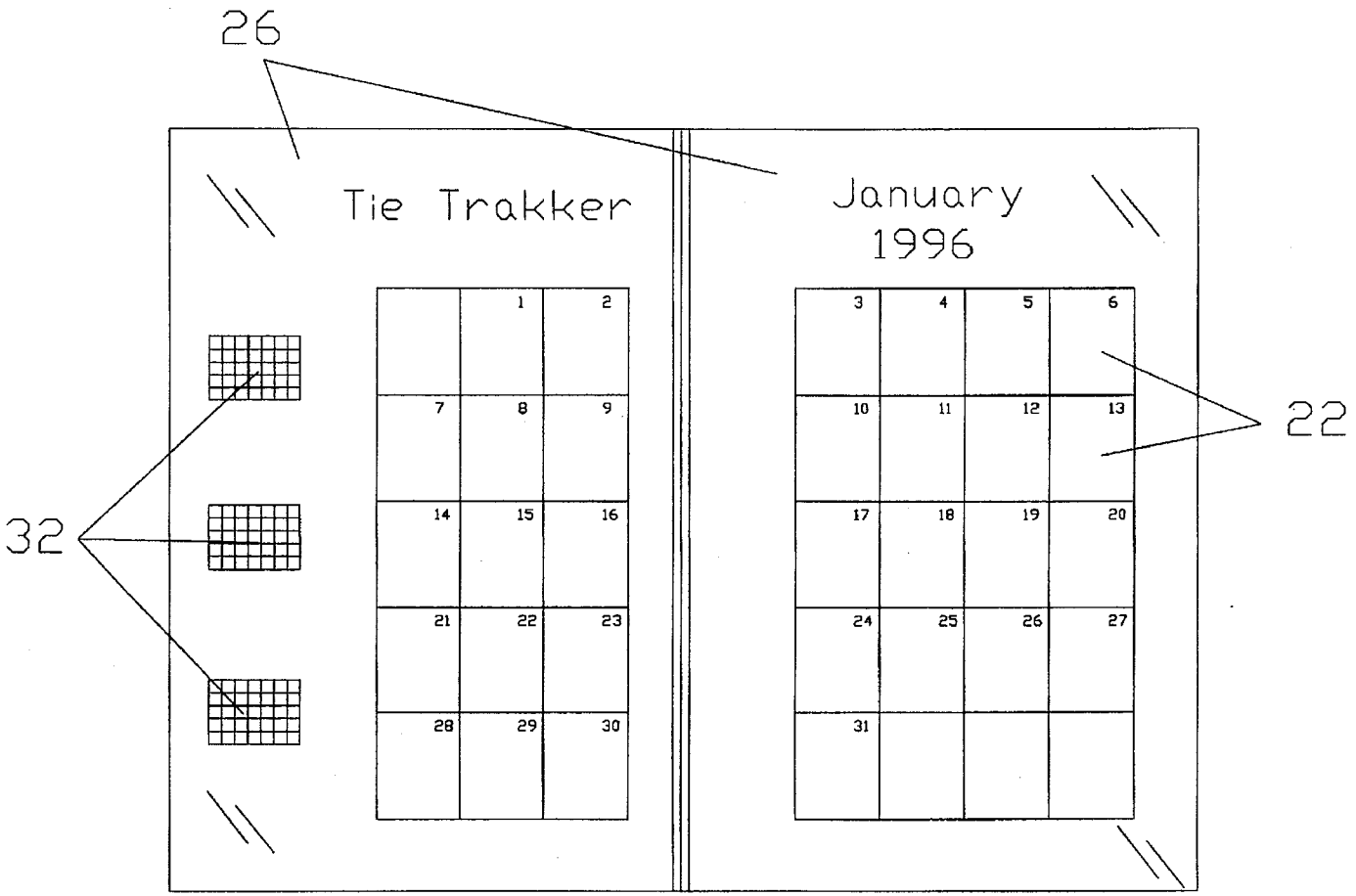
FIG. 8 is a front view of a calendar page in the log book of the invention having spaces provided for a daily information log for each day in a one month period of time.

FIG. 8 shows a calendar page 26 from a log book (not shown) of the present invention having daily log information 22 recorded thereon for each day in a one month period of time and spaces for recording additional calendar information 32. It is contemplated for calendar pages 26 may be assembled in a bound format, as well as in a loose-leaf configuration.

It is contemplated for storage container 2 to be made of flexible plastic material. To use the present invention, each garment requiring wardrobe management, such as tie 4, would have one marking tag 12 affixed thereto by one removable male fastening component 8 and one removable female fastening component 20. Alpha-numeric information 10 on each marking tag would be recorded in the log book (not shown) containing calendar pages 26. A description of the garment such as tie 4 to which it is attached would also be recorded adjacent to alpha-numeric information 10. Each time tie 4 or another garment having one marking tag 12 affixed thereto is worn, its use would be recorded to create a history of use by placing alpha-numeric information 10 from each affixed marking tag 12 on calendar pages 26 in recording format 24 of daily log information 22 which corresponds to the date of use. Planning future usage of tie 4 and other garments (not shown) would also be recorded on calendar pages 26 solely by the use of alpha-numeric information 10. It is contemplated for the garments and garment accessories requiring wardrobe management, such as tie 4, to be stored by garment type and in consecutive order using the numbers associated with marking tags 12 so that each garment can be easily located when needed for use.

What is claimed is:

1. A wardrobe management system for garments and garment accessories, said wardrobe management system comprising a log book in a calendar format having a plurality of specified areas therein for recording simplified garment identification and numerical information so as to provide a simplified history of garment use from which to easily plan future garment usage and prevent the wearing of identical garments to similar functions; a plurality of garment marking tags each having said simplified garment identification and numerical information recorded thereon, each of said simplified garment identification and numerical information on one of said marking tags being unique from that recorded on all other of said marking tags; a plurality of fastening devices for use in removably securing said marking tags to said garments and said garment accessories without permanent damage to said garments, said garment accessories, and said marking tags; and at least one storage container having a plurality of pockets thereon for housing said marking tags, said fastening devices, and those of said garment accessories which are sufficiently small in size to fit within said pockets.

2. The system of claim 1 wherein said pockets comprise a plurality of outside pockets and at least one inside pocket.

3. The system of claim 2 wherein said outside pockets each have a transparent face so that a user can easily look through said faces to view objects stored within each of said outside pockets.

4. The system of claim 1 wherein said calendar format comprises opposing pairs of calendar pages and daily log information for each day in a one month period being recorded on each opposing pair of calendar pages.

5. The system of claim 1 wherein each of said fastening devices comprise at least one removable male fastening component and at least one removable female fastening component and wherein each of said marking tags has a hole therethrough for insertion of one of said removable male fastening components to affix said marking tag to one of said garments.

6. A method for using the wardrobe management system of claim 1 wherein said method comprises the steps of removing said marking tags and said fasteners from said pockets in said storage device; associating one of said marking tags having said unique simplified garment identification and numerical information attached thereto with each of said garments in said wardrobe which requires management; affixing each of said marking tags to its associated garment with one of said fasteners; recording said simplified garment identification and numerical information into said log book to create a history of usage for said garments; and using said history of usage to plan future usage of said garments so as to prevent the wearing of identical garments at similar functions.

* * * * *